US006707765B2

(12) United States Patent
Stekelenburg

(10) Patent No.: US 6,707,765 B2
(45) Date of Patent: Mar. 16, 2004

(54) PLATE STRUCTURE FOR A TIMER

(75) Inventor: Albert Stekelenburg, Taipei (TW)

(73) Assignee: All-Time Inc., Taipei (TW)

( * ) Notice: Subject to any disclaimer, the term of this patent is extended or adjusted under 35 U.S.C. 154(b) by 447 days.

(21) Appl. No.: 09/901,591

(22) Filed: Jul. 11, 2001

(65) Prior Publication Data

US 2003/0012085 A1 Jan. 16, 2003

(51) Int. Cl.[7] ..... G04F 10/00; G04F 8/00; H01H 43/10; H01H 7/08

(52) U.S. Cl. ..... 368/107; 200/38 R; 200/380 A

(58) Field of Search ..... 368/10, 28, 107–109; 200/38 R, 38 D, 38 DA; 307/141, 141.4

(56) References Cited

U.S. PATENT DOCUMENTS 2,677,732 A * 5/1954 Miller ..... 200/38 DA
5,715,214 A * 2/1998 Svarnias ..... 368/10

* cited by examiner

*Primary Examiner*—Vit Miska
(74) *Attorney, Agent, or Firm*—Troxell Law Office PLLC

(57) ABSTRACT

A key mode timer with a displaying window and an improved plate structure. The plate structure includes the setting keys, an upper plate and an inner plate. The upper plate has a displaying window. The upper plate is rotated with the setting keys to set the time and the inner plate is fixed. When the displaying window rotates with the upper plate, the numbers and the letters printed on inner plate are shown through the window to enable the user to easily read the time information shown on the timer.

8 Claims, 3 Drawing Sheets

PLATE STRUCTURE FOR A TIMER

FIELD OF THE INVENTION

This invention relates to a timer, more particularly to a mechanical structure of a timer. This is a displaying window on the plate of the timer, and below the window, a fixed plate with indicia is provided.

BACKGROUND OF THE INVENTION

People usually use timers to control electrical output circuits. In other words, in order to have the circuit turned on or off, we can set a time by using the timer, and have the timer turn the circuit on or off. Most likely, these timers are used in a daily or a weekly mode.

The known timers are typically of two types: mechanical or digital. This case is only about mechanical timers, especially the setting key mode timers which are used by pressing a key up/down or inward/outward to achieve the goal of controlling the on and off functions of the timer.

A lot of information is usually printed on the limited area on the face plate of a timer. Some required information is: the numbers of the time setting key, which includes the day and time intervals, or even the hour or minute, and so on. These numbers are provided for users to observe and to control the timer setting. However, to print all these numbers and letters in a limited space often makes the numbers or letters too small to see, especially for those who do not have good eyesight, or from a farther distance, or for those timers that are under dim light conditions.

The information provided on the plate rotates with the plate as the time goes. However, by using the known structure, it is hard to specify the numbers or letters the timer needs to show.

SUMMARY OF THE INVENTION

An object of the present invention is to provide a plate structure for a timer having an information plate and a displaying window, such that larger letters and numbers can be seen through the window.

Another object of this invention is to separate the plate structure into two plates. The upper plate will rotate with the setting keys as the timer operates, and the inner plate will always be fixed and have enlarged indicia printed on it. Due to the rotation of the upper plate, which contains the window, various indicia can be seen through the window, for example: MON, TUE, WED . . . ; or, 1, 2, 3 . . . 11, 12, twelve numbers with white background representing daytime and black background representing night time.

Another object of this invention is to provide the current time, similar to a clock. The time may be displayed through the displaying window and could show either the day of the week or the current time.

DETAILED DESCRIPTION OF THE PREFERRED EMBODIMENTS

Figure 1:
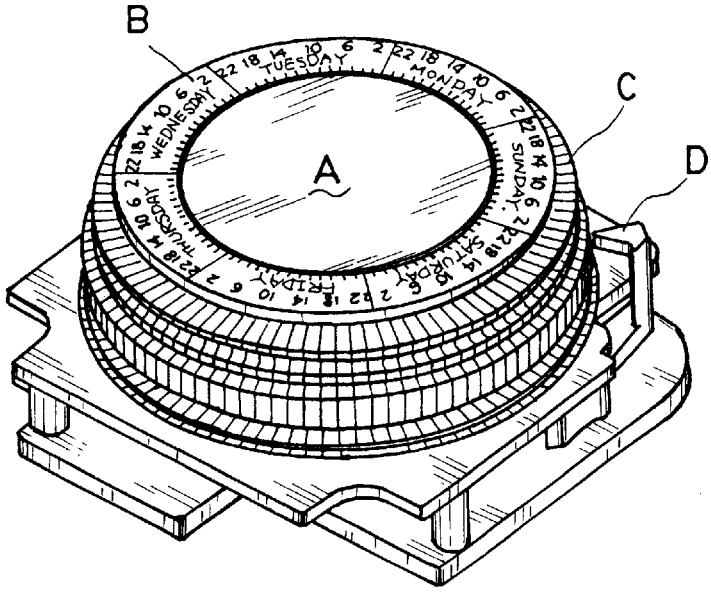
FIG. 1 Prior Art
FIG. 1 is a perspective view of a prior art timer.
Figure 2:
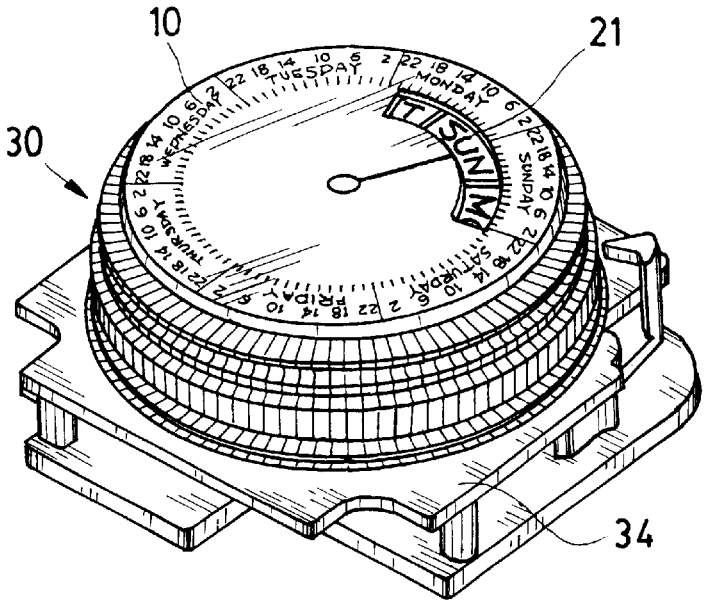
FIG. 2 is a perspective view of the present invention.
Figure 3:
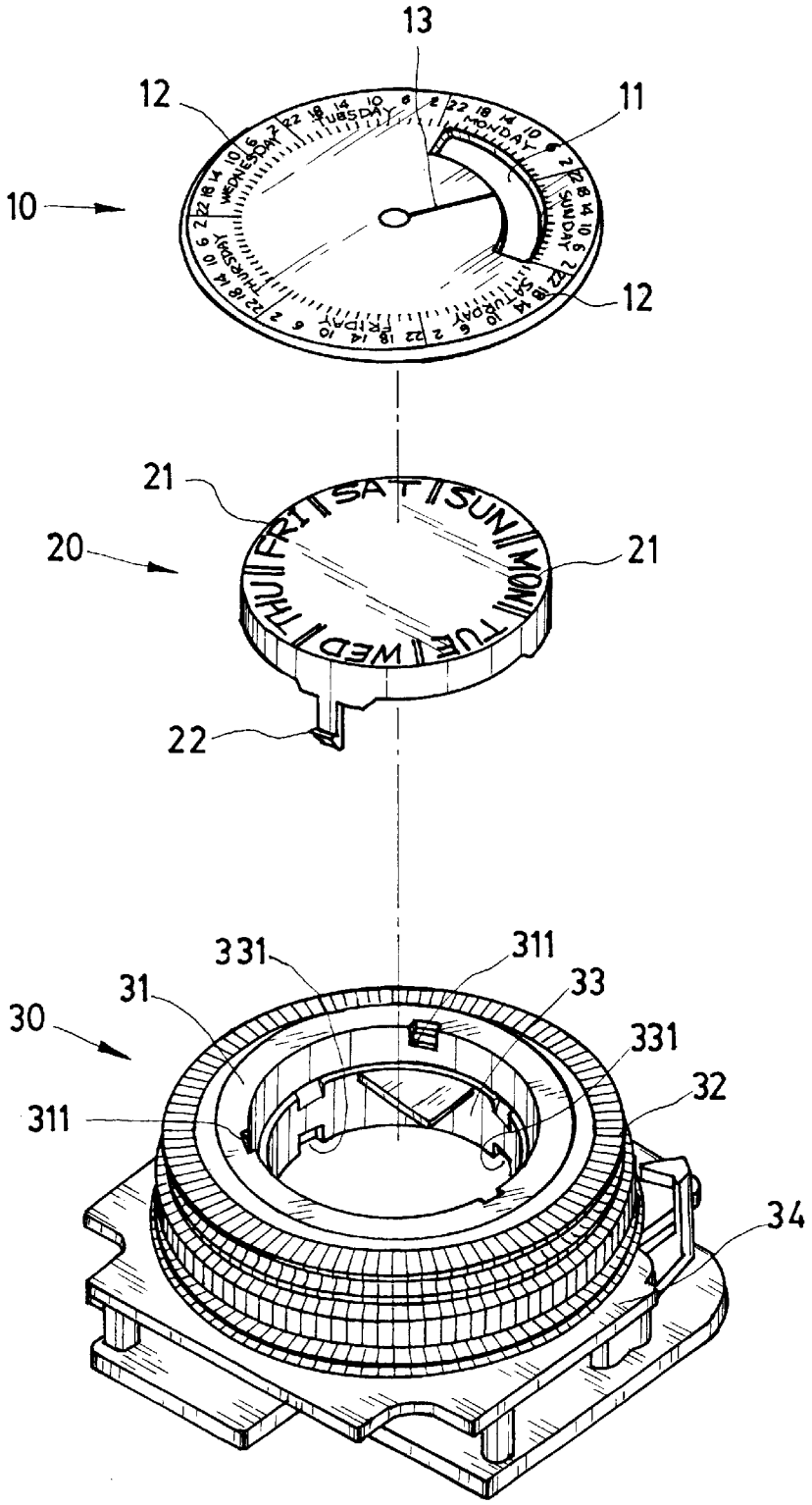
FIG. 3 is an exploded view of the present invention.

As best seen in FIG. 2 and FIG. 3, the structure of the present invention includes an upper plate 10, an inner plate 20 and a time setting device 30.

Figure 4:
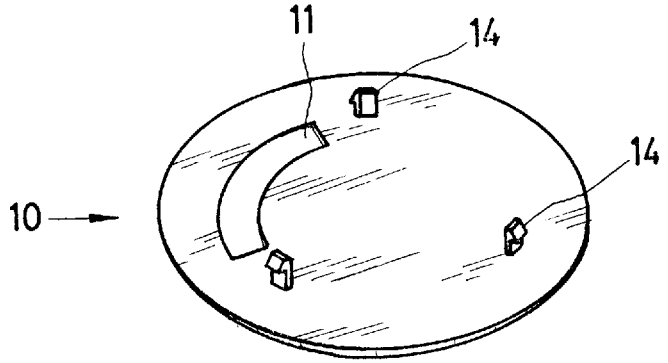
FIG. 4 is a rear perspective view of the upper plate.

The upper plate 10 is a circular flat board having a displaying window 11, information indicia 12, and an arrow 13. A plurality of snap-in hooks 14 are also provided on a bottom of the upper plate 10, as shown in FIG. 4. The information indicia, which may include numbers, letters or words, is printed adjacent the circumference of the upper plate, similar to other mechanical timers.

The inner plate 20 is located under the upper plate 10. It has a circular flat top surface with indicia 21 printed thereon adjacent to the circumference. A plurality of snap-in hooks extend from the bottom of the inner plate 20 adjacent to the circumference thereof.

The time setting device 30 in FIG. 2 and FIG. 3 is similar to the structure of the prior art timer and is used to set the desired time. It contains a movable circular base 31, and at the circumference of the base 31, setting keys are provided. Fixed base 33 is provided at the bottom of the base 31. The fixed base 33 is placed on the fixed support base 34, which makes the structure fixed. The structure of the movable circular base 31 and the setting keys 32 is for running in a clockwise direction.

The snap-in hooks 14 of the upper plate 10 are snapped into engagement with notches 311 on the base 31. Therefore, the upper plate 10 will move simultaneously with the movable circular base 31 and the setting keys 32. At the same time, the displaying window 11 will also move with the base 31 in a clockwise direction.

The snap-in hooks 22 of the inner plate 20 are engaged with notches 331 on the fixed base 33. As a result, the inner plate is fixed like the fixed base 33.

The displaying window 11 of the upper plate 10 is placed inwardly of the information indicia 12 and has the same radius as the inner side of the information indicia 12, as they share the same center point. The length of the displaying window 11 is sufficient to show the specific indicia 21, and the width of the displaying window 11 is sufficient to show the height of the specific indicia 21.

The indicia 21 on the inner plate 20 is located so as to be viewed through the displaying window 11. As the displaying window is running clockwise, indicia 21 can be seen through the displaying window 11. Indicia 21 is printed in a large format that is easy to recognize. In addition, arrow 13 points at the indicia 21, enabling the user to easily determine the approximate current time through the displaying window 11.

The upper plate 10 covers and runs on the top of the inner plate 20. Therefore, some indicia 21 printed on the inner plate 20 can be seen through the displaying window 11 on the upper plate 10. By using this kind of structure, the timer gains a new way of displaying the current time. Also, the indicia 21 can be printed larger and made more obvious, so that even if the user is under a dim-light condition, or observing from a farther distance, the user can still determine the current time. The indicia 21 can be made to glow in the dark, allowing the user to determine the time during nighttime.

Figure 5:
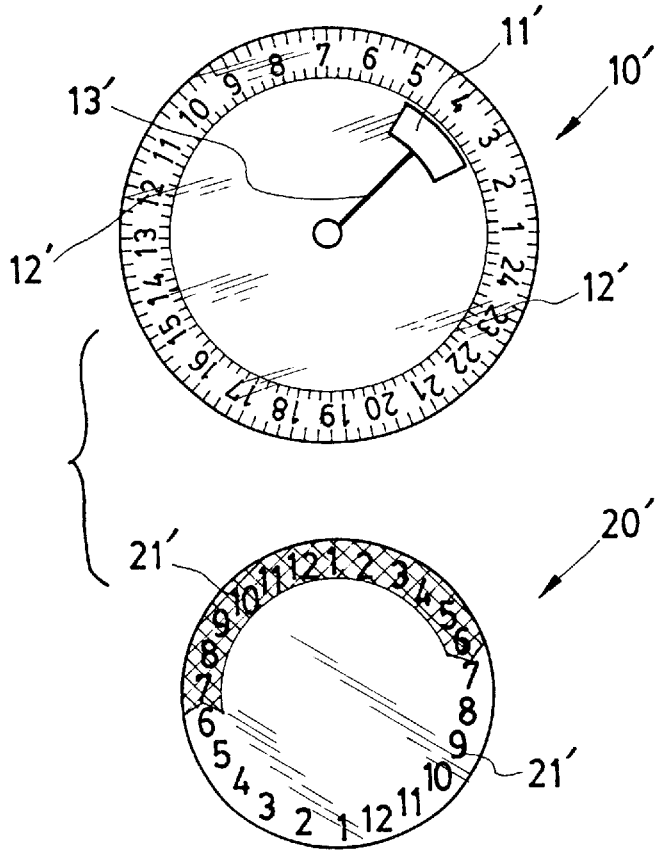
FIG. 5 is a partial exploded view of the upper plate and the inner plate.

According to FIG. 5, for daily use timers, the information indicia 12' and 13' can be numbers provided on the upper plate 10', and the indicia 21' provided on the inner plate 20' can be seen through the displaying window 11'.

The foregoing description is provided for illustrative purposes only and should not be construed as limiting this invention, the scope of which is defined solely by the appended claims.

What is claimed is:

1. An improved plate structure for a timer having a fixed base and a movable base thereon, the movable base rotatable with respect to the fixed base, comprising:

a) an inner plate having a circular configuration with first indicia located on an upper surface adjacent to a periphery thereof, the inner plate attached to the fixed base of the timer so as to be fixed in position; and, b) an upper plate having a circular configuration with second indicia on an upper side adjacent to a periphery thereof, the upper plate attached to the movable base of the timer so as to move therewith, the upper plate having a displaying window therethrough located inwardly of the second indicia, the upper plate being located adjacent to the upper surface of the inner plate whereby, as the movable base of the timer rotates relative to the fixed base of the timer, the upper plate rotates relative to the inner plate such that the first indicia is visible through the displaying window.

2. The improved plate structure for a timer of claim 1 further comprising a plurality of snap-in hooks extending from the upper plate and engaging corresponding notches in the movable base of the timer so as to attach the upper plate to the movable base.

3. The improved plate structure for a timer of claim 1 further comprising a plurality of snap-in hooks extending from the inner plate and engaging corresponding notches in the fixed base of the timer so as to attach the inner plate to the fixed base.

4. The improved plate structure for a timer of claim 1 wherein the first indicia includes words.

5. The improved plate structure for a timer of claim 1 wherein the first indicia includes numbers.

6. The improved plate structure for a timer of claim 1 wherein the second indicia includes words.

7. The improved plate structure for a timer of claim 1 wherein the second indicia includes numbers.

8. The improved plate structure for a timer of claim 1 wherein the upper plate further comprises an arrow indicia on the upper surface extending inwardly towards a center from the displaying window.

* * * * *